United States Patent [19]

Almström

[11] Patent Number: 4,485,627

[45] Date of Patent: Dec. 4, 1984

[54] SOLAR ENERGY CONVERSION PLANT

[75] Inventor: Sten-Hakan Almström, Lund, Sweden

[73] Assignee: United Stirling AB, Sweden

[21] Appl. No.: 485,830

[22] Filed: Apr. 18, 1983

[51] Int. Cl.[3] ..... F02G 1/04; F02G 1/06

[52] U.S. Cl. ..... 60/641.14; 60/521; 60/525; 60/698

[58] Field of Search ..... 60/517, 525, 521, 522, 60/641.8, 524, 641.14, 698, 716, 718

[56] References Cited

U.S. PATENT DOCUMENTS 3,559,398 2/1971 Meijer et al. ..... 60/521

4,045,978 9/1977 Abrahams et al. ..... 60/522 X

*Primary Examiner*—Allen M. Ostrager

*Attorney, Agent, or Firm*—Finnegan, Henderson, Farabow, Garrett & Dunner

[57] ABSTRACT

A solar energy conversion plant is composed of a number of conversion units. Each unit is a hot gas engine coupled to a generator. All hot gas engines are connected to common tube mains one of which contains working gas of high pressure while another contains gas of low pressure. A compressor is arranged to maintain the pressures in the mains and is separately governed.

4 Claims, 2 Drawing Figures

SOLAR ENERGY CONVERSION PLANT

PRIOR ART DISCLOSURE

"Design Study of a Kinematic Stirling Engine for Dispersed Solar Electric Power Systems".

Report No DOE/NASA/0056-79/2 NASA CR-159588.

BACKGROUND OF THE INVENTION

1. Field of the Invention

The present invention relates to a solar energy conversion plant comprising a plurality of solar heated, closed-cycle hot gas engines.

2. Description of the Prior Art

Solar energy conversion plants of the above type have hitherto been composed of a number of individual engines, each engine being provided with a control system for supplying gas to, or removing gas from, its working gas charges, and with a compressor provided for sucking gas from a low pressure tube system to a high pressure tube system including a high pressure gas reservoir.

In known conversion plants, each compressor has been directly coupled to the shaft of the respective engine and thus all the compressors-the number of which corresponds to the number of engines in the plant ran continuously.

Also each engine must be provided with two safety valves in order to avoid excessive gas pressure in case the pressure regulating valves should fail in operation.

SUMMARY OF THE INVENTION

The object of the present invention is to provide a solar energy conversion plant having a plurality of closed cycle, hot gas engines in which the overall gas control system has been simplified to reduce initial capital outlay as well as maintenance costs and to obtain increased reliability.

The conversion plant is in accordance with the invention characterised in that all engines of the plant are connected to be supplied with high pressure working gas from a first tube main, which is in turn supplied from a high pressure gas reservoir, and are connected to dump working gas to a second tube main, and a common, separately driven compressor operatively connected to deliver gas from the second tube main to the high pressure gas reservoir. The connection between the first two main and the high pressure reservoir can be through a pressure reduction valve.

DESCRIPTION OF THE PREFERRED EMBODIMENT

Figure 1:
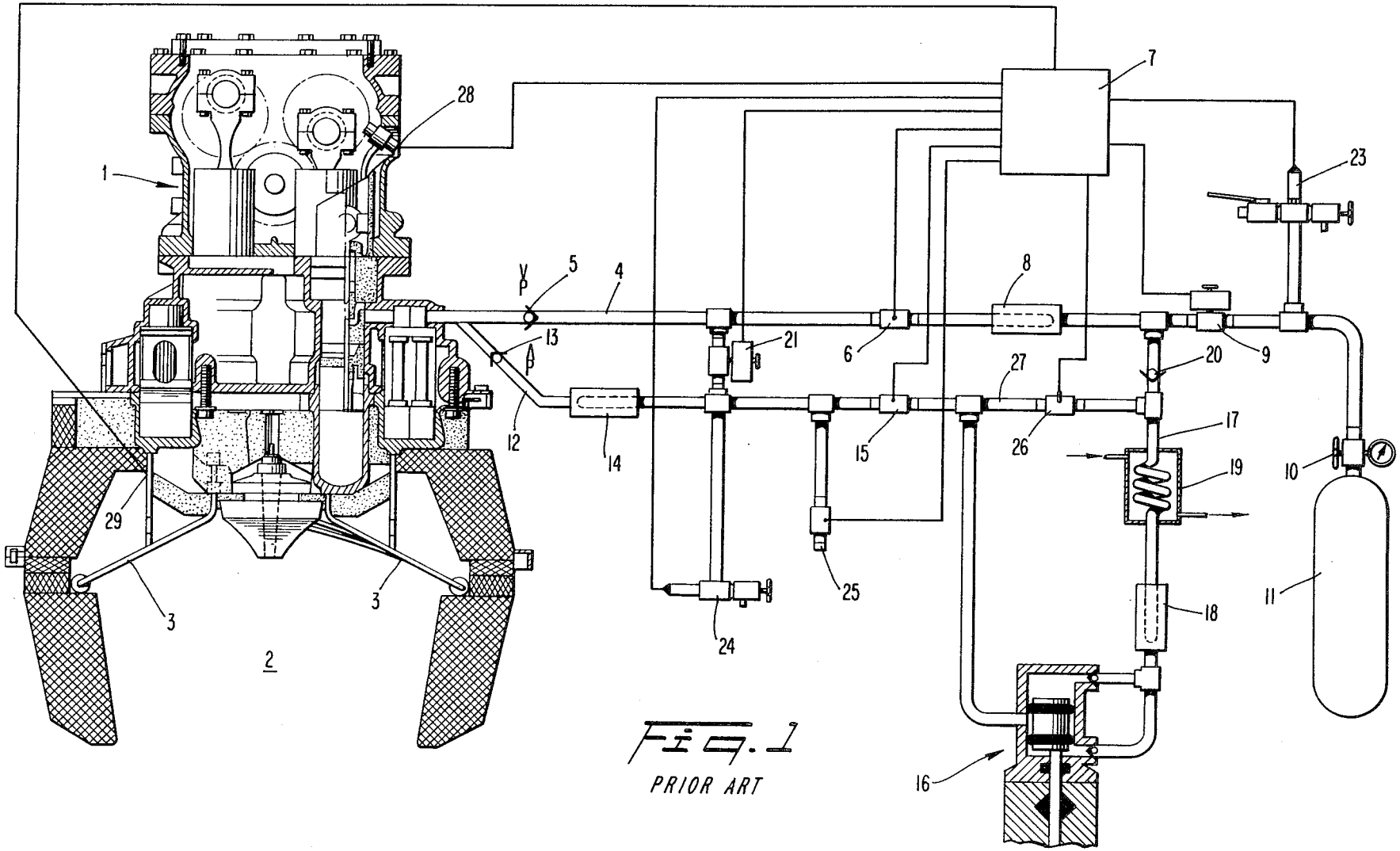
FIG. 1 PRIOR ART
FIG. 1 shows a gas pressure control system of known design adapted to a single engine plant and FIG. 2 shows a solar conversion system according to the invention.

In FIG. 1 a solar powered Stirling engine of known design has been generally designated by the reference numeral 1. At the lower part of the engine concentrated solar radiation is passed upwards through an aperture 2 and causes heating of tubes 3 containing engine working gas. At a given speed of the engine the pressure of the working gas determines the torque and thus the engine power output. Gas is supplied via a first tube 4 containing a check valve 5 allowing flow of gas only in the direction into the engine. Said first tube 4 also contains a supply solenoid valve 6 governed by a digital control unit 7. The tube 4 which also contains a filter 8, a shut-off solenoid valve 9 and a manual shut-off valve 10 is connected to a high pressure gas reservoir 11.

A second tube designated by the reference numeral 12 contains a check valve 13 allowing flow of gas in the direction out of the engine 1 only. Said second tube 12 contains a filter 14 and a dump solenoid valve 15 and is connected to the suction side of a double-acting compressor 16 the delivery side of which is connected to the said first tube 4 via a further tube 17. The further tube 17 contains a filter 18, a cooler 19 and a check valve 20. An emergency short-circuiting solenoid valve 21 is provided in a tube 22 connecting said first and second tubes 4 and 12 respectively. A first safety valve 23 is provided in the tube 4 between the valves 9 and 10 and a second safety valve 24 as well as an external dumping solenoid valve 25 is mounted in the tube 12 between the filter 14 and the dump solenoid valve 15.

A compressor short-circuiting valve 26 is mounted in a tube 27 connecting the suction and the delivery side of the compressor. Together with the valve 6 also the valves 9, 15, 21, 23, 24, 25 and 26 are governed by the control unit 7. A speed transducer 28 and a thermocouple 29 are also connected to the unit 7.

The known device illustrated in FIG. 1 and described above will operate basically as follows:

In case the solar radiation increases the temperature of the hot gas engine tubes 3 will increase and the thermocouple 29 will give a corresponding signal to the control unit 7. Said unit 7 will now cause an opening of the supply solenoid valve 6. Gas will enter into the engine and cause a higher mean pressure of the working gas and a higher engine torque. The speed of the engine is constant because of its connection to an AC generator connected to an existing grid (not shown). However, the energy output is increased and thus the high temperature parts of the hot gas engine are correspondingly cooled so as to maintain a constant temperature in spite of the increase of solar energy input.

The valves 15 and 21 are closed when the solenoid supply valve 6 is open and gas will pass from the reservoir 11 into the engine. As soon as the desired temperature is obtained the valve 6 is closed. It may also be desired to decrease the amount of working gas in the engine in order to increase the temperature of the tubes 3 and this is obtained by opening the valve 15. Gas may now pass via the tube 12 to the compressor 16 and from the compressor 16 to the reservoir 11.

Excessive pressures in the reservoir 11 and the engine 1 are avoided by the safety valves 23 and 24 respectively. In case both valves 6 and 15 are closed—a quite normal case—the valve 26 may be opened and release the compressor 16.

The valves 21 and 25 are emergency valves. The valve 21 will eliminate all power output from the engine by equalizing the working gas pressures in the engine. The valve 25 has the same effect by dumping the gas. The speed transducer 28 has been mounted for use in case the connection to the grid should be cut off.

Figure 2:
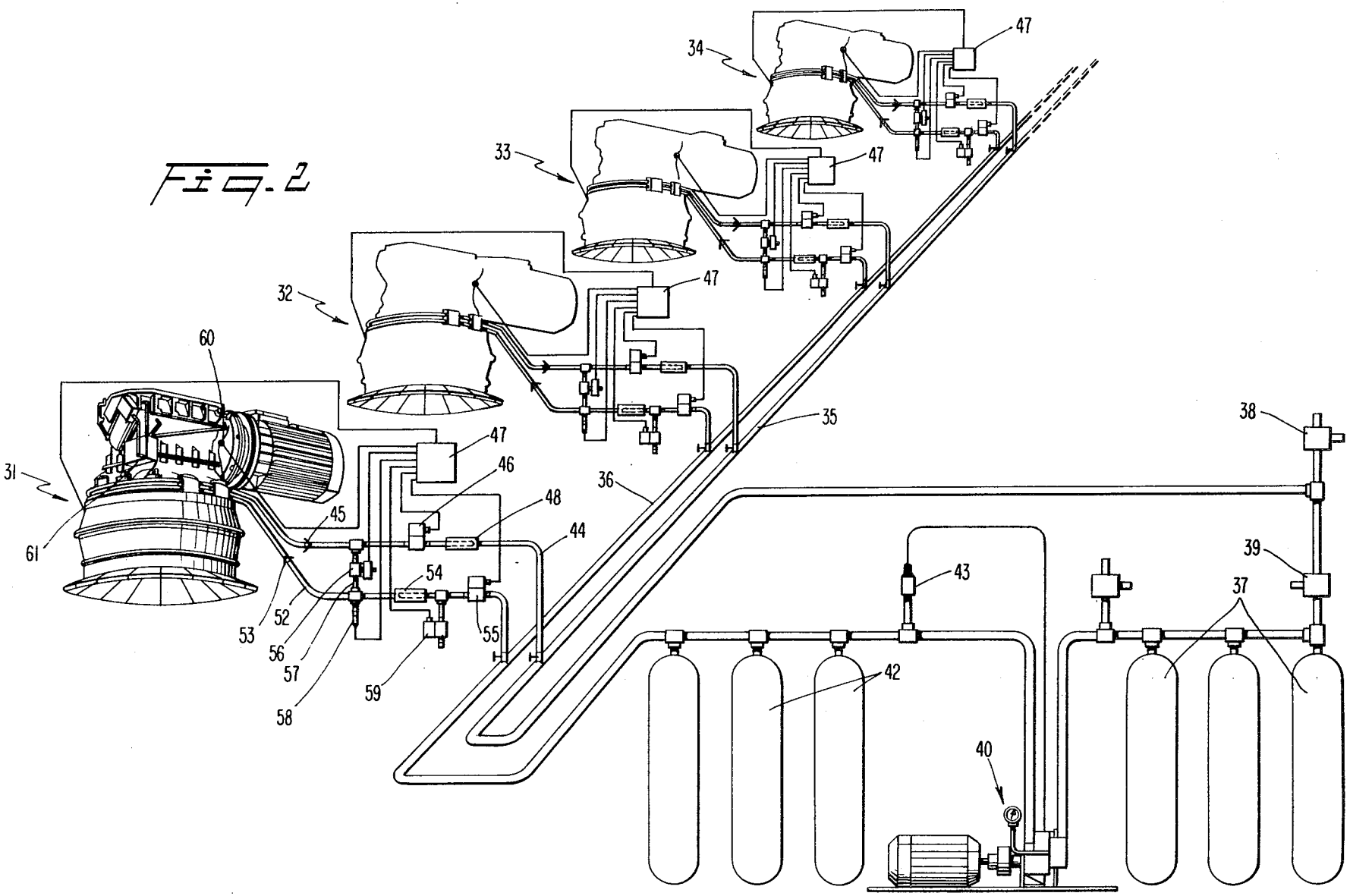

A conversion plant according to the invention and shown in FIG. 2 comprises four Stirling engines 31, 32, 33 and 34 each being solar heated and coupled to electric generators. Only the Stirling engine 31 needs to be described as it is identical with the other engines of the plant.

The plant comprises a first tube main 35 and a second tube main 36. The first tube main is connected to a high pressure gas reservoir 37 and contains a safety valve 38 and a pressure reduction valve 39 the latter being mounted close to the reservoir 37. A compressor 40 driven by an electric motor delivers gas to the reservoir 37 a safety valve 41 being mounted in the tube connection between compressor and reservoir.

The second tube main 36 is connected to the suction side of the compressor 40 and is connected to a low pressure gas reservoir 42. A pressure switch 43 is mounted in the second tube main 36 starting the compressor 40 as soon as the gas pressure in the tube main 36 exceeds a certain value.

The engine 31 is provided with a pressure control system having basically the same function as that described above with reference to FIG. 1. However, the gas control system of the engine 31 has been simplified as will be understood from the description below.

A first tube 44 containing a check valve 45 allowing flow of gas only in the direction into the engine 31 has been connected to the first tube main 35. Said first tube also contains a supply solenoid valve 46 governed by a digital control unit 47. The tube 44 also contains a filter 48.

A second tube 52 contains a check valve 53 allowing flow of gas only in the direction out of the engine 31. Said second tube contains a filter 54 and a dump solenoid valve 55. An emergency short-circuiting solenoid valve 56 is mounted in a tube 57 connecting the said first and second tubes 44 and 52.

A maximum pressure transducer 58 and an external dumping solenoid valve 59 are also mounted in the second tube 52. A speed transducer 60 and a thermocouple 61 are provided at the engine 31 and connected to the unit 47.

The energy conversion plant according to the invention will operate as follows:

The part of the plant common to all engines 31–34 consists of the tube mains 35 and 36 as well as the compressor 40 and the reservoirs 37 and 42.

The compressor 40 delivers gas to the reservoir 37 which is able to store gas at pressures above 20 MPa. The pressure reduction valve 39 ensures that the pressure in the tube main 35 remains about 12 MPa. The pressure switch 43 starts the compressor 40 as soon as the pressure in the second tube main 36 exceeds about 6 MPa.

Thus the gas pressures in the two tube mains 35 and 36 may be kept almost constant and due to the reservoirs 37 and 42 a rather small compressor 40 may be used for the purpose.

Each engine—e.g. the engine 31—will operate as follows:

In case the thermocouple 61 calls for decrease in temperature and thus increased engine pressure the solenoid valve 46 is opened and gas supplied to the engine 31 from the first tube main 35. As soon as the desired temperature is obtained the vvalve 46 is shut off again. Conversely the dump valve 55 is activated in case the engine temperature should be increased causing gas to flow from the engine into the second tube main 36. At constant engine speed this will decrease the power output and thus increase the working gas temperature—at constant solar energy input.

For emergency stop of the engine it is necessary to be able to use either the short-circuiting valve 56 or the external dump valve 59.

The provision of two tube mains 35, 36 in which predetermined pressures are kept almost constant makes it possible to substantially decrease the number of valve functions at each engine of the plant.

I claim:

1. A solar energy conversion plant comprising a plurality of solar heated, closed-cycle hot gas engines, each engine being independently operable and being provided with a control system for introducing gas to or removing gas from its working gas charges; a common working gas supply system, said supply system including a high pressure working gas reservoir; a first tube main connected to be supplied working gas by said reservoir; a second tube main, wherein each engine control system is operatively connected to be supplied with high pressure working gas from said first tube main and to dump working gas to said second tube main; and a common, separately driven compressor operatively connected to deliver gas from said second tube main to said high pressure gas reservoir.

2. The solar energy conversion plant as in claim 1 wherein said first tube main is connected to said high pressure reservoir through a pressure reduction valve.

3. The solar energy conversion plant as in claim 1 further including a low pressure working gas reservoir connected to said second tube main.

4. The solar energy conversion plant as in claim 2 further including a low pressure working gas reservoir connected to said second tube main.

* * * * *